United States Patent [19]

Lohning

[11] 4,120,051

[45] Oct. 10, 1978

[54] MIXING APPARATUS

[75] Inventor: Franklin M. Lohning, Sugar Land, Tex.

[73] Assignee: Franklin Enterprises, Inc., Sugar Land, Tex.

[21] Appl. No.: 834,715

[22] Filed: Sep. 19, 1977

[51] Int. Cl.[2] ..... B01F 7/16

[52] U.S. Cl. ..... 366/142; 366/250; 366/251; 366/315

[58] Field of Search ..... 366/142, 244, 245, 250, 366/251, 61, 65, 66, 282, 348; 310/68 B

[56] References Cited

U.S. PATENT DOCUMENTS

| | | | |
|---|---|---|---|
| 3,080,152 | 3/1963 | Lendved | 366/61 |
| 3,168,295 | 2/1965 | Dorrell | 366/61 |
| 3,991,984 | 11/1976 | Porter | 366/142 |
| 3,999,046 | 12/1976 | Porter | 366/142 |
| 4,027,859 | 6/1977 | Stone | 366/142 |

*Primary Examiner*—Robert W. Jenkins
*Attorney, Agent, or Firm*—Pravel, Wilson & Gambrell

[57] ABSTRACT

A mixing apparatus for mixing fluids, such as drilling muds, in a reservoir, each fluid having different densities requiring different torques for proper mixing thereof, with the mixing apparatus having provisions therewith operatively controlling the motor mechanism for limiting the maximum horsepower of the motor mechanism absorbed in mixing the fluid to substantially the rated horsepower of the motor mechanism to prevent overloading of the motor mechanism.

9 Claims, 7 Drawing Figures

MIXING APPARATUS

BACKGROUND OF THE INVENTION

The present invention relates to mixing devices and more particularly pertains to apparatus for mixing and blending highly viscous fluids or slurries such as drilling fluids, concrete, petroleum crudes, aqueous oleaginous emulsions and the like.

Mixing devices, sometimes known as mud mixers in the drilling industry, are used to prevent separation and viscosity changes of highly viscous fluids such as drilling fluids which create problems for conventional mixing devices in that they are unable to accommodate the varying changes in densities. For example, it is not unusual for drilling fluids to separate into various layers whereupon the heavier, more dense fluids settle to the bottom of the reservoir whereas the lighter fluids rise to the top. In such a situation, it is desirable that the fluid be kept at an overall consistent, uniform density and therefore, it becomes important for such mixing devices to be used in order to insure the uniform density and proper agitation thereof. Due to the large range of densities of fluids encountered, such mixing devices as in the prior art can experience overload conditions which can and are detrimental to the working life of such a mixing device. For example, if a very dense liquid or fluid is encountered, the motor of the mixing device may become overloaded, causing breakdowns, or at a minimum, the motor will be stressed to such a point that it useful life is severely reduced. Of course, if the mixing device fails to operate, the drilling operations must be stopped and, as is well known, maintaining an idle drilling operation is very costly.

Prior art mixing devices include such mixers as disclosed in U.S. Pat. Nos. 2,809,816 and 2,284,765. In some instances, prior art devices such as U.S. Pat. Nos. 4,004,786; 1,995,465; and, 1,450,326 disclose the use of multiple mixing blades and deflection plates for insuring suitable mixing within the mixing tank. In attempts to insure thorough mixing within the tank, deflection plates my be mounted with a rotating shaft of the mixers, as in the above-cited patents, or within and in attachment with the inner sides of the tank as in U.S. Pat. Nos. 3,709,664; 3,222,141; and, German Pat. No. 2,104,380.

Similarly, in attempts to overcome problems of the significant torques encountered in the drilling fluids, some prior art patents are directed towards varying the angle of attack of the mixing blades as in U.S. Pat. Nos. 3,966,176; 3,920,227; and, 3,516,646. So far as known, no attempt has been made to directly control or limit the amount of torque that the motor for such a mixing device must absorb in such a fashion to prevent overloading of the motor upon encountering significantly dense fluids.

SUMMARY OF THE INVENTION

The present invention is a new and improved mixing device for mixing fluids in a reservoir wherein each fluid may have different densities requiring different torques for proper mixing thereof, wherein the mixing apparatus includes a mixing device in the reservoir for mixing the fluid therein, a motor mounted with the reservoir and operably connected to the mixing mechanism for powering the mixing mechanism for mixing the fluid within the reservoir and limiting provisions operatively controlling the motor for limiting the maximum horsepower of the motor absorbed in mixing the fluid to substantially the rated horsepower of the motor to prevent overloading of the motor. The motor is automatically controlled in such a fashion that when rated horsepower is reached, the speed of rotation is reduced as the density of the fluid increases, thus maintaining the motor at its rated horsepower.

DETAILED DESCRIPTION OF THE PREFERRED EMBODIMENTS

Figure 1:
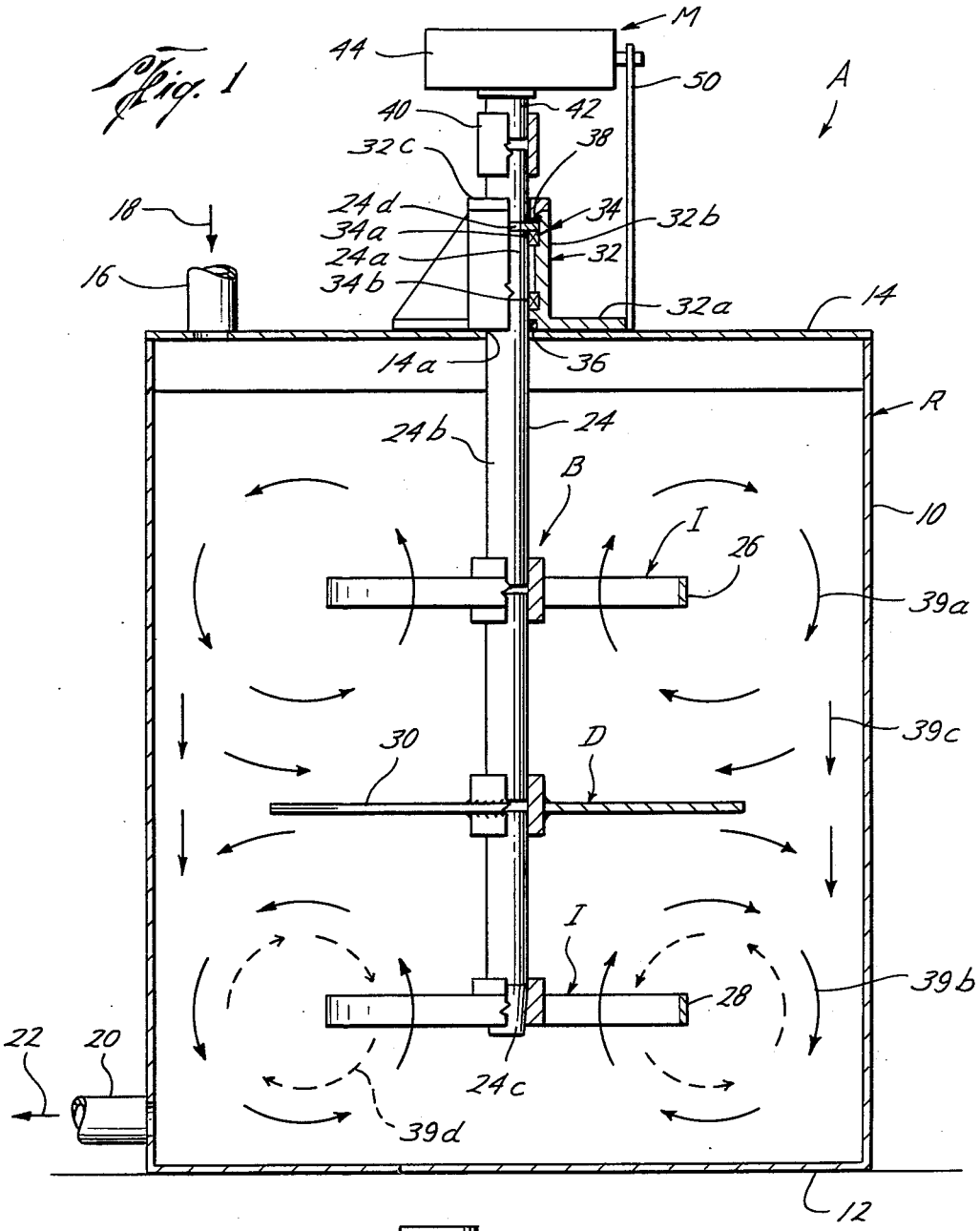
FIG. 1 is an elevational view, partially schematic and partially in section, of the mixing apparatus of the present invention as powered by a hydraulic motor means.

In the drawings, the mixing apparatus A of the present invention is to be used for mixing fluids in a reservoir R. The mixing apparatus A includes mixing means B, motor means M and limit means L. Unless otherwise stated, it is preferred that the components of the present invention be made of steel or other suitable high-strength material capable of withstanding the stresses and strains involved in mixing such fluids, without failure thereof.

As shown in FIG. 1, the mixing apparatus A of the present invention is adapted for mounting with a reservoir R which is preferably a large structure of large capacity, typically on the order of 1,200 barrels. It is preferred that the reservoir be cylindrical, however, other sizes and shapes of reservoirs R may be used.

The reservoir R includes a cylindrical wall 10, a bottom portion 12, and a roof 14. The roof 14 may be circular, or alternatively, merely of supports sufficient to support the motor means M. Further, the roof 14 should be vented to allow gases within the fluids to be mixed to escape. The roof 14 preferably is adapted to be detachably mounted with the cylindrical wall 10 in any suitable fashion. The reservoir R further includes a suitable inlet 16 for receiving fluids flowing in the direction of arrow 18 typically from separators, such as shale shakers (not shown), into the reservoir R and a suitable outlet 20 for directing agitated fluid flow from the reservoir R in the direction of arrow 22 after mixing with the mixing apparatus A of the present invention.

The circular roof 14 is provided with an opening **14*a* that is located substantially in its center such that the motor means M and mixing means B may be mounted with the circular roof 14 in vertical alignment with the opening 14***a* of the circular roof 14.

The mixing means B of the mixing apparatus A is preferably mounted within the reservoir R for mixing the fluid therein. The mixing means B includes impeller means I and deflection means D mounted on drive shaft 24. Preferably, the impeller means includes at least an upper impeller 26 and a lower impeller 28 mounted on drive shaft 24. The drive shaft 24 preferably has an upper end 24*a*, mid-portion 24*b* and lower end 24*c*. Preferably, the upper impeller 26 is mounted with the drive shaft 24 adjacent mid-portion 24*b*, and the lower impeller 28 is mounted with the drive shaft 24 adjacent lower end 24*c*. The deflection means D such as deflection plate 30 is mounted therebetween the upper impeller 26 and lower impeller 28 on the drive shaft 24. It will be appreciated that multiple impeller means I and deflection means D may be incorporated and used with the mixing apparatus A of the present invention for providing suitable mixing of the liquid within the reservoir R.

The upper end 24*a* of the drive shaft 24 extends through the opening 14*a* in the circular roof 14 of the reservoir R into support housing 32. The support housing 32 includes a base portion 32*a* and a cylindrical wall portion 32*b*. Bearing means 34, including upper bearing 34*a* and lower bearing 34*b*, is housed in cylindrical wall portion 32*b* of the support housing 32 for rotatably mounting the upper end 24*a* of the drive shaft 24 within the support housing 32. An appropriate seal 36 prevents any unwanted fluid communication between the bearing means 34, such as with bearing 34*b*, and the liquid or fluid within the reservoir R. A split ring 38 is mounted within a groove 24*d* formed in the upper end 24*a* of the drive shaft 24 for supporting the drive shaft 24 with the support housing 32. An appropriate cover 32*c* secures the split ring 38-drive shaft 24 with the support housing 32.

The upper end 24*a* of the drive shaft 24 extends through and up from the support housing 32 for attachment with the motor means M by a suitable coupling 40. Preferably, the coupling 40 is of a oil-heat-shrink type interference fit for suitably coupling the upper end 24*a* of the drive shaft 24 with the output shaft 42 of the motor means M.

The motor means M is capable of providing torque to the drive shaft 24 for rotating the impellers 26, 28 on the drive shaft 24, having the deflection plate 30 therebetween. Such rotation results in turbulent flow schematically shown by arrows 39*a*, 39*b*, respectively, for impellers 26, 28. The deflection plate 30 acts to separate the turbulent action designated by arrows 39*a*, 39*b* into at least two mixing areas to enhance mixing within each area by allowing such turbulent action to be fully manifest. This turbulent action results in a further turbulent mixing zone adjacent to the annular end portion of the deflection plate 30 shown adjacent to arrow 39*c* wherein turbulent mixing between the turbulent zones shown by arrows 39*a*, 39*b* occurs to insure proper mixing of the fluid within the reservoir R. Alternatively, the flow from the impeller means I may be reversed from that of arrow 39*b* to that shown by arrow 39*d*, as desired. As noted hereinabove, the drive shaft 24 may have many sets of impellers and deflection plates to have multiple turbulent mixing zones, all of which help to aid in mixing of the fluid, such as drilling mud, within the reservoir R and to further prevent separation of such fluid within the reservoir R.

Figure 2:
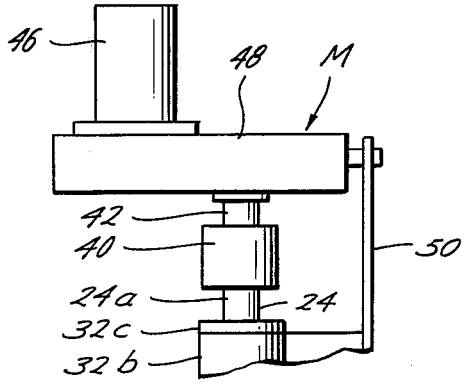
FIG. 2 is an elevational view of the motor means of the mixing apparatus of the present invention utilizing an electric motor means with integral gear box assembly.

As shown in FIG. 1, the motor means M is a hydraulic motor 44 that is preferably of a positive, fixed displacement type that is currently manufactured and commercially available by several companies. The hydraulic motor 44 and its particular characteristics are discussed more fully hereinbelow in the discussion concerning FIGS. 3 and 4. Alternatively, as shown in FIG. 2, an electric motor 46, as discussed more fully hereinbelow, having an integrally mounted gear box 48 therewith may be used as an alternative to the hydraulic motor 44. In both instances, either the hydraulic motor 44 or the gear box 48 have output shafts 42, respectively, capable of being received in coupling 40 for direct connection with the drive shaft 24. A suitable torque arm 50 is mounted with the motor means M and attached to either the base portion 32*a* of the support housing 32 or the circular roof 14 of the reservoir R for preventing rotation of the motor means M with respect to the output shaft 42 thereof.

Figure 3:
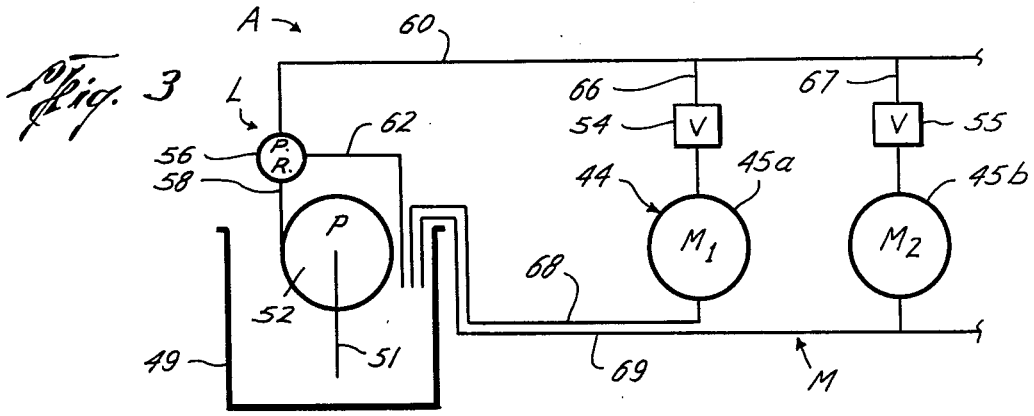
FIG. 3 is a schematic of the limit means of the present invention as coupled and operably connected with a hydraulic motor means of the present invention.

As shown schematically in FIG. 3, the hydraulic motor 44 may include several hydraulic motors including motors 45*a*, 45*b*. The hydraulic motors 45*a*, 45*b* may be of any suitable type such as those manufactured by Vickers or Lucas, as long as they are preferably of the positive, fixed displacement type. As is shown schematically in FIG. 3, hydraulic motors 45*a*, 45*b* are powered by a suitable hydraulic pump schematically shown as 52, capable of providing hydraulic fluid under pressure to the hydraulic motors 45*a*, 45*b*. Flow regulators 54, 55 regulate the flow of hydraulic fluid to the hydraulic motors 45*a*, 45*b*, respectively, with pressure regulator 56 limiting the maximum pressure within the system as is well known in the art. The hydraulic pump 52 draws hydraulic fluid from the hydraulic reservoir 49 through line 51 and thereafter provides hydraulic fluid under pressure in line 58 to the pressure regulator 56, to limit the maximum hydraulic pressure in hydraulic feed line 60. When the motor means M is operating at a reduced flow or not at all, excess fluid from the pump 52 is redirected through hydraulic line 62 into the hydraulic reservoir 49 to prevent overheating of the pump 52. Further, if excess pressure exists in hydraulic feed line 60, such is bled off in hydraulic line 62 which again circulates back into hydraulic reservoir 49. The pressure regulated hydraulic fluid in feed line 60 is thereafter directed into hydraulic lines 66, 67, therethrough flow regulators 54, 55, respectively, for limiting the volume per unit time of fluid flow through hydraulic motors 45*a*, 45*b*, respectively, to hence limit the volume of fluid flow and thus limit the speed of rotation of the hydraulic motors 45*a*, 45*b*, respectively, with the hydraulic fluid thereafter being returned to the hydraulic reservoir 49 by hydraulic return lines 68, 69, respectively. Multiple additional hydraulic motors (not shown) may be powered by the hydraulic pump 52, if such is desired, with each such motor capable of powering the mixing apparatus A of the present invention.

Figure 4:
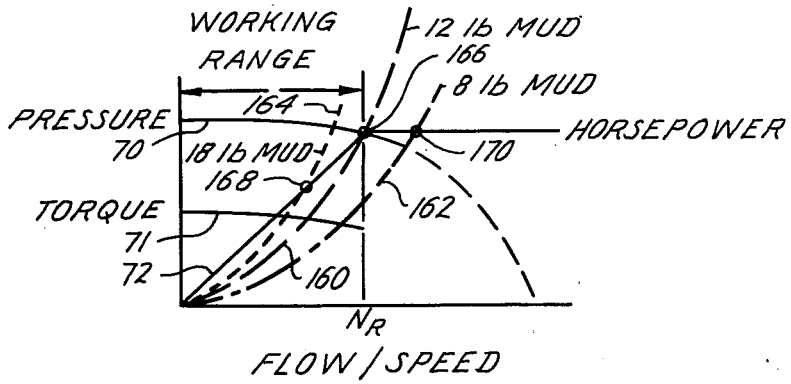
FIG. 4 is a graphical representation of the pressure versus volume characteristic of the hydraulic motor means of the present invention.

By using a positive, fixed displacement hydraulic motor, such as hydraulic motors 45*a*, 45*b*, the limit means L includes the pressure regulator 56 and flow regulators 54, 55. The limit means L operatively controls the motor means M including hydraulic motors 45*a*, 45*b* for limiting the maximum horsepower of the motor means M absorbed in mixing the fluid within the reservoir R with the mixing means B to substantially the rated horsepower of the motor means M to prevent overloading of the motor means M. As is known, with respect to hydraulic motors, the work done is a function of pressure and flow. By using a hydraulic pump 52 having a "flat" pressure-flow characteristic, then its working range is as shown in FIG. 4. The speed of each of the individual hydraulic motors 45*a*, 45*b* will be accordingly regulated by the flow regulators 54, 55, respectively. Further, inasmuch as the hydraulic motors 45*a*, 45*b* are of a positive, fixed displacement type, the speed remains constant at the set value of flow regulators 54, 55 until rated horsepower is reached. This is a result of the substantially "flat" pressure-flow curve 70 of FIG. 4. At rated horsepower, the flow is fixed and the pressure, remaining substantially the same over the entire working range, is fixed and as a consequence, the maximum horsepower of such hydraulic motors 45*a*, 45*b* is limited to the rated horsepower. It should also be noted that the available torque shown by curve 71, for such motors 45*a*, 45*b* follows substantially the same "flat" curve characteristic as evident in the pressure curve 70 during the working range as shown in the graph of FIG. 4. The available horsepower, as shown by curve 72, increases substantially linearly as pressure and flow increase to rated horsepower, where thereafter horsepower remains constant at such rated amount.

Figure 5:
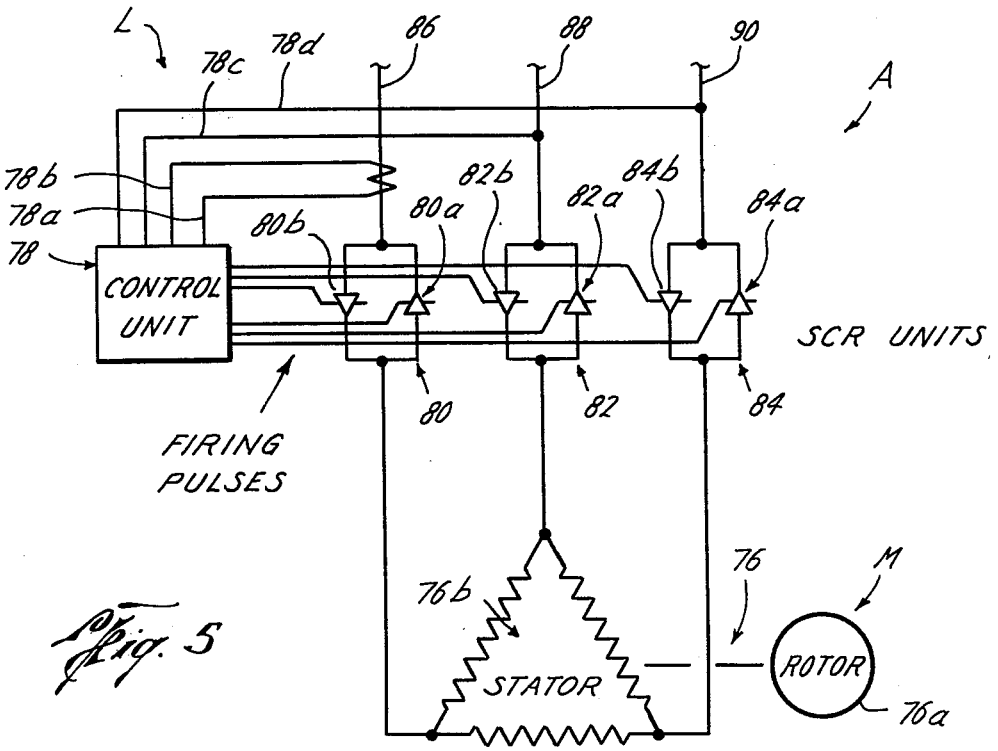
FIG. 5 is a schematic of the limit means of the present invention as adapted to be used with an electrical motor means.

The motor means M of the mixing apparatus A of the present invention may include an electrical motor means, rather than a hydraulic means. As shown in FIG. 5, it is preferred that the motor means M, when electrically powered, be of an induction motor 76 shown schematically in FIG. 5. Preferably, the induction motor 76 is of a "solid-rotor" type. Such has fewer deeply embedded rotor bars than a conventional induction motor, or no rotor bars, which tend to increase the resistance of the rotor 76*a* of the induction motor 76 having desirable effects as discussed more fully hereinbelow. It is preferred that the limit means L of the embodiment of FIG. 5 include a control unit 78 coupled with multiple SCR (silicon controlled rectifier) units 80, 82, 84. The multiple SCR units 80, 82, 84 may include two or three such units for three-phase supply. Alternatively, other configurations may be used. It is preferred that the SCR units 80, 82, 84 include thyristors in antiparallel connection shown schematically as 80*a*, 80*b*, 82*a*, 82*b*, 84*a*, 84*b*, respectively, or, alternatively, triacs (not shown). The thyristors or triacs are utilized for blocking or gating current flow as is known in the electrical arts.

As shown in FIG. 5, the control unit 78 may be of any type, such as those manufactured by Westinghouse or General Electric. The limit means L is schematically wired to the induction motor 76 which is shown schematically to be receiving three-phase power. The control unit 78, through lines 78*a*, 78*b*, monitors current flowing in power line 86 while lines 78*c*, 78*d* are used to monitor voltage between power lines 88, 90. Power lines 86, 88, 90 all provide power to the stator shown schematically as 76*b* of the induction motor 76, which in turn causes rotation of the rotor 76*a* as the changing current in the stator 76*b* induces a magnetic field causing the rotor 76*a* to rotate. The rotor 76*a* is connected with the mixing means B and drive shaft 24 as described hereinabove in FIG. 1.

The current signal as read by lines 78*a*, 78*b* of the control unit 78 and the voltage signal as read through lines 78*c*, 78*d* are combined in the control unit 78 to give a horsepower reading. This horsepower signal together with a current limit signal in the control unit 78 regulate and control the firing angle of the SCR units 80, 82, 84 for effectively varying the voltage to the induction motor 76 to limit both the current and the horsepower drawn by the induction motor 76. This acts to prevent overloading of the induction motor 76 during high torque, overload situations. As is known, horsepower equals voltage multiplied by current multiplied by cosine of the phase angle between the voltage and the current. Thus, the control unit 78 limits the amount of horsepower that may be drawn by the induction motor 76 to the rated horsepower, to prevent drawing of excess horsepower which may result in overloading thereof. The control unit 78 effectively controls the gating of the SCR units 80, 82, 84.

Figure 6:
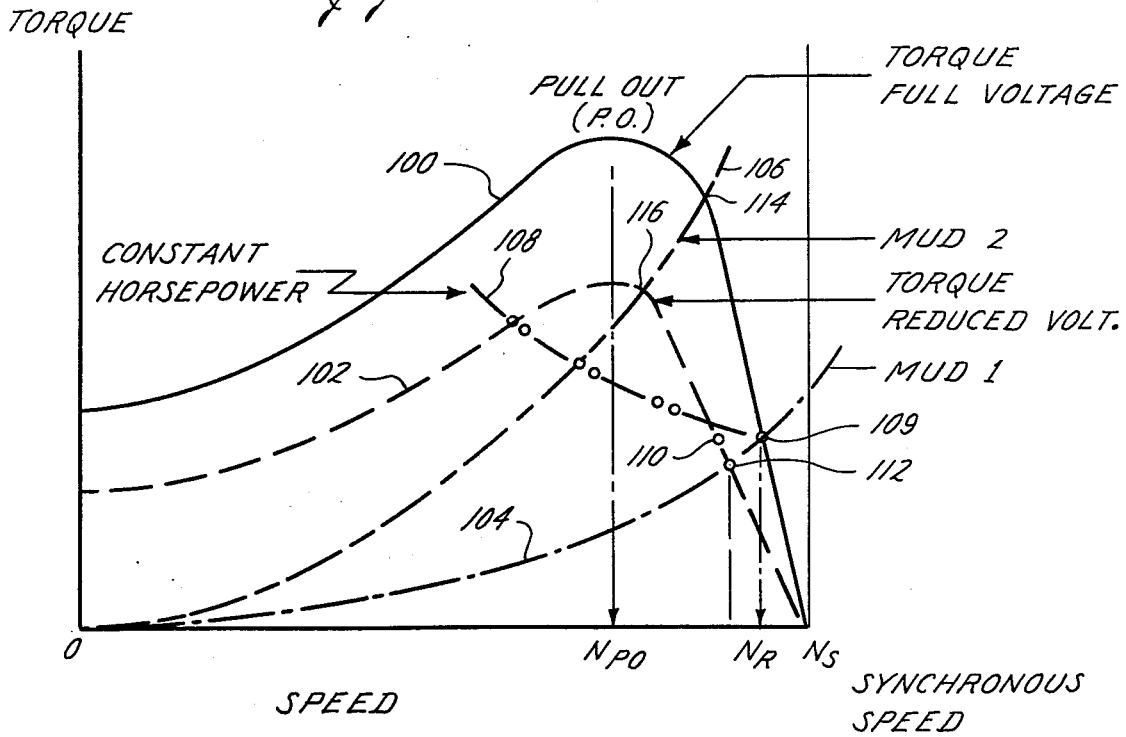
FIG. 6 is a graphical representation of a characteristic torque-speed curve of a standard, industrial electrical induction motor that may be used as the motor means of the present invention; and, FIG. 7 is a graphical representation of torque-speed curve of an electrical induction motor employing increased "series" characteristic for the motor means of the present invention.

The characteristic torque-speed curve of a standard industrial, induction motor is shown in FIG. 6. The rated speed, $N_R$, at which the induction motor produces its rated torque and horsepower is close to synchronous speed, $N_S$. Furthermore, it should be noted that the pull out speed, $N_{PO}$, also occurs at relatively low values of slip. This is typically referred to as a "shunt" characteristic. The full voltage torque curve is shown as curve 100 in FIG. 6. However, the effect of reduced voltage on the characteristic curve 100 is to reduce the torque (which is proportional to the voltage squared) to that of a value as shown characteristically in FIG. 6 by the dashed curve 102. The reduction in voltage does not effectively alter the pull out speed, $N_{PO}$, at which pull out occurs. Thus, the characteristic shape of the curve 102 is essentially the same as curve 100, but reduced in shape and magnitude.

As shown in FIG. 6, curves 104, 106 for mud 1 and mud 2, respectively, provide typical torque curves for muds wherein mud 1 is of a lesser density than mud 2. Curve 108 designates a line of constant horsepower (which may be the rated horsepower of the motor) upon the torque-speed curve of FIG. 6. If the induction motor 76 were operating at rated speed in mixing mud 1, the intersection of graph 100 and 104 would be at point 109. If the torque required by the mixing apparatus A of the present invention were constant, then the working point would shift from point 109 to point 110 with an associated drop in speed. Inasmuch as the motor means M has an applied torque from the impeller means I of the form that:

$$T = kN^2$$

then the actual operating point on the reduced voltage torque curve 102 would be at point 112 rather than 110 due to the characteristic of the curve 104.

However, if the mud density is changed to that of a heavier mud, as shown for the curve 106 of mud 2, the induction motor 76 of the motor means M becomes heavily overloaded at that point and a reduction in voltage could not effect a stable drive nor could horsepower and current be kept within their ratings inasmuch as both points 114 and 116 are well in excess of the constant horsepower requirements of curve 108. By employing a "solid rotor" with the induction motor 76, a "series" characteristic can be imparted to it whereby the series characteristic together with the voltage as controlled by the control unit 78 may be utilized to enable a much heavier mud, such as mud 2, to be accommodated, by reducing the speed and thereby keeping the horsepower of the induction motor 76 within the rating thereof. As is known in the art, all speeds from zero to pull out speed, $N_{PO}$, as viewed on curves 100, 102, represent an unstable condition inasmuch as any increase in speed over this range results in an increase in torque. A stable condition occurs between the pull out speed, $N_{PO}$, and rated speed, $N_R$, for curves 100, 102, since the torque-slip derivative is positive, i.e. for any increase in torque, a decrease in speed results.

Figure 7:
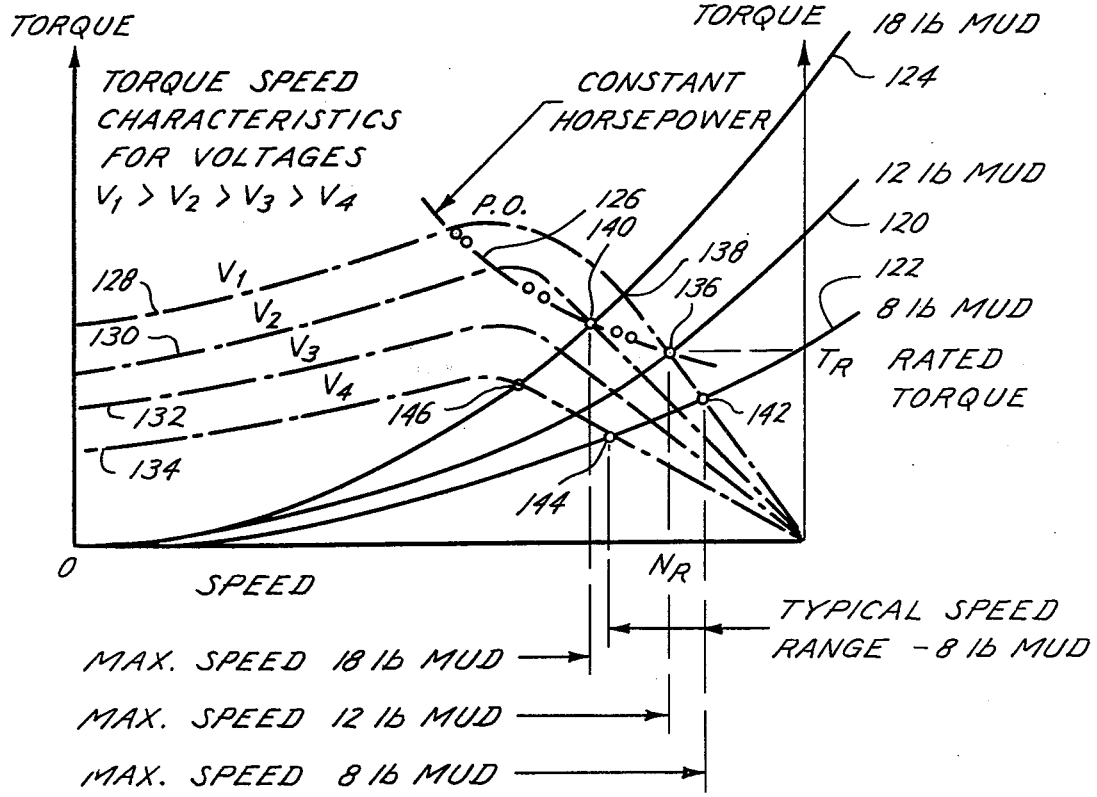

FIG. 7 shows characteristic torque-speed curves as in FIG. 6 for an induction motor 76 of the motor means M of the mixing apparatus A of the present invention for various voltages, wherein the mixing apparatus A is designed for a 12 pound mud operating at full speed. The 12 pound mud has been selected for the sake of explanation as the point for rated horsepower and speed; however, other fluids of different densities, such as a 14 pound mud for example, could be used for the design criterian. The 12 pound mud is designated by curve 120 while the 8 pound mud and 18 pound mud are designated by curves 122, 124, respectively. The graph of constant horsepower is indicated by curve 126 with curves 128, 130, 132, 134, respectively, designating the torque-speed curves wherein voltage 1 is greater voltage 2, is greater than voltage 3, is greater than voltage 4, respectively. As signified by the intersection of curves 120, 126, 128 at point 136, the induction motor 76 would be operating at its rated speed and horsepower for the 12 pound mud. On the other hand, an 18 pound mud, as signified by curve 124, would be unable to operate at voltage 1 of curve 128 since point 138 exceeds the constant horsepower curve 126. Thus, the maximum speed that the 18 pound mud could be mixed by the mixing apparatus A would be signified at point 140, where the reduced voltage of voltage 2 as signified by curve 130 intersects curve 124 below curve 126 in order to keep within the ratings set for the induction motor 76 of the motor means M. On the other hand, for the 8 pound mud as signified by curve 122, the motor means M would be able to develop a maximum speed (for faster mixing) as shown at point 142, a speed higher than the speed for the 12 pound mud, with the horsepower drawn being less than the maximum rated horsepower signified by curve 126. The speed range between points 142 and 144 on curve 122 indicate a typical speed range for mixing an 8 pound mud. It will be appreciated that the range of mixing speed can be increased by reducing the speed at which pull out occurs, by increasing the "series" characteristic of the induction motor 76; that is, by increasing the resistance within the rotor 76*a* itself, as detailed hereinabove. Further, the maximum speed range for mixing according to the curves set out in FIG. 7 for an 18 pound mud of curve 124 would be indicated between points 140, 146, but all within the allowable horsepower rating of the induction motor 76 for such an 18 pound mud since within the restraints of curve 126.

As shown in FIG. 4, curves 160, 162, 164, respectively, relate to 12, 8, and 18 pound muds. As signified by the intersection of curves 160, 72, at point 166, the hydraulic motor 44 would be operating at its rated speed and horsepower for the 12 pound mud. On the other hand, an 18 pound mud, as signified by curve 164, would be unable to operate at rated speed inasmuch as point 168 at the intersection of curves 164 and 72 is below the rated speed of the hydraulic motors 44. Any amount in excess of that speed corresponding to point 168 would result in an overload condition inasmuch as curve 164 thereafter is above the horsepower curve 72. Thus, the maximum speed that the 18 pound mud could be mixed by the mixing apparatus A would be signified at point 168. On the other hand, for the 8 pound mud, as signified by curve 162, the motor means M would be able to develop a maximum speed (for faster mixing) as shown at point 170, a speed higher than the speed for the 12 pound mud, with the horsepower drawn being less than the maximum rated horsepower signified by curve 72. The speed range-overload considerations for the curves of FIG. 4 are similar to that described hereinabove with regard to the curves of FIGS. 6 and 7.

Therefore, by using the mixing apparatus A of the present invention, prior art V-belts and pulleys are eliminated. No requirement for constant attention to the pitch angle of mixing blades to limit torque on the motor means M is necessary in order to accommodate mixing fluids, such as muds of various densities. To the contrary, the present invention provides a mixing apparatus A that has built-in protections against overloading the motor means M from excess horsepower-speed potentials. This "built-in" feature includes the limit means L for the motor means M to prevent overloading thereof and helps to eliminate problems encountered with mixing non-uniform mud mixtures. It will be appreciated that the limit means L acts to vary the speed of rotation of the motor means M inversely as the torque requirements for mixing the fluid vary, to prevent overloading of the motor means M. While it is recognized that as mud densities, for example increase, the speed of mixing will correspondingly be reduced if over the rated horsepower of the motor means M, such is a small price to pay as compared to the cost of shutting down an entire drilling operation, should the mixing apparatus fail due to overload conditions. The mixing apparatus A of the present invention will insure that the unit maintains its operational capabilities, though unexpected and/or expected high density muds, which correspond to high torque-horsepower requirements, may be encountered in mixing.

The foregoing disclosure and description of the invention are illustrative and explanatory thereof, and various changes in the size, shape and materials as well as in the details of the illustrated construction may be made without departing from the spirit of the invention.

I claim:

1. A mixing apparatus for mixing fluids in a reservoir, each fluid having different densities requiring different torques for proper mixing thereof, comprising:

mixing means in the reservoir for mixing the fluid within the reservoir;

motor means mounted with the reservoir and operably connected to said mixing means for powering said mixing means for mixing the fluid within the reservoir; and, limit means operably controlling said motor means for limiting the maximum horsepower of said motor means absorbed in mixing the fluid to substantially the rated horsepower of said motor means to prevent overloading of said motor means.

2. The mixing apparatus of claim 1, wherein:

said motor means includes a hydraulic system having a hydraulic motor means powered by and in communication with hydraulic fluid under pressure from hydraulic pump means for mixing the fluid; and, said limit means includes pressure regulation means mounted with said hydraulic system in communication with said hydraulic motor means and said hydraulic pump means for limiting fluid pressure within said hydraulic system to prevent overloading said hydraulic motor.

3. The mixing apparatus of claim 2, further including:

valve means communicating with said hydraulic system for regulating the flow of hydraulic fluid to said hydraulic motor for regulating the maximum speed thereof.

4. The mixing apparatus of claim 1, wherein:

said motor means includes an electrical induction motor means; and, said limit means includes control means for controlling voltage and current flow to the stator windings of said electrical induction motor means to limit the horsepower drawn by said motor means to prevent overloading thereof.

5. The mixing apparatus of claim 4, wherein:

said control means includes:

silicon controlled rectifier units; and, a control unit for controlling firing of said silicon controlled rectifier units for limiting current flow to the stator windings of said electrical induction motor means.

6. The mixing apparatus of claim 1, wherein:

said limit means varies the speed of rotation of said motor means inversely as the torque requirements for mixing the fluid vary, to prevent overloading of said motor means.

7. The mixing apparatus of claim 6, wherein said mixing means includes:

impeller means for agitating and mixing the fluid within the reservoir; and, drive shaft mounted with said motor means and operably connected to said motor means and said impeller means for imparting the rotational torque of said motor means to said impeller means for mixing the fluid in the reservoir.

8. The mixing apparatus of claim 7, further including:

a deflection plate mounted with said drive shaft for forming at least two mixing areas within the reservoir adjacent said impeller means for enhanced mixing of the fluid.

9. The mixing apparatus of claim 8, wherein:

a turbulent mixing zone is formed within the reservoir adjacent said deflection plate and between said mixing areas.

* * * * *